US005457082A

United States Patent [19]

Simpson et al.

[11] Patent Number: 5,457,082

[45] Date of Patent: Oct. 10, 1995

[54] THERMAL PRINTING METHOD

[75] Inventors: William H. Simpson, Pittsford; Jacob J. Hastreiter, Jr., Spencerport; Mark S. Janosky, Rochester, all of N.Y.

[73] Assignee: Eastman Kodak Company, Rochester, N.Y.

[21] Appl. No.: 360,909

[22] Filed: Dec. 21, 1994

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/913, 914; 503/227

[56] References Cited

U.S. PATENT DOCUMENTS 5,240,897 8/1993 Braun et al. ..... 503/209

5,280,005 1/1994 Nakajima et al. ..... 503/227

*Primary Examiner*—B. Hamilton Hess

*Attorney, Agent, or Firm*—Harold E. Cole

[57] ABSTRACT

A process of forming a dye transfer image comprising imagewise-heating, by means of a thermal print head, a dye-donor element comprising a support having thereon a dye layer comprising a sublimable, metallizable dye precursor dispersed in a polymeric binder, and transferring a dye image to a dye-receiving element comprising a support having thereon a dye image-receiving layer containing a metal ion to form the dye transfer image, wherein the support of the dye-receiving layer is heated above ambient temperature from the side opposite to the side facing the thermal print head either prior to or during transfer of the thermal dye image.

5 Claims, No Drawings

THERMAL PRINTING METHOD

This invention relates to a thermal printing method, and more particularly to the use of additional heating of an element containing a thermally-transferred metallized dye.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

U.S. Pat. Nos. 5,240,897 and 5,280,005 relate to a dye diffusion printing process in which a metallizable dye precursor is thermally transferred from a dye-donor element to a dye-receiver element containing a metal ion. After transfer, the metallized dye precursor forms a dye complex with the metal ion in the receiver.

However, there is a problem with that process in that the reaction between the metallizable dye precursor and the metal ion is frequently incomplete, so that the resulting print densities are relatively low. If additional heat is applied to the system for a longer time, the extent of the reaction can be increased without having to increase the printing time. However, such increased heating of the dye-donor/dye-receiver assemblage under the thermal print head can lead to donor sticking, whereby the dye-donor and dye-receiver elements adhere to one another which leads to malfunction of the printing process.

It is an object of this invention to provide a thermal dye transfer process employing metallizable dye precursors which provides an increased transfer density over that obtained by the prior art, without sticking of the dye-donor to the dye-receiver.

These and other objects are achieved in accordance with this invention which comprises a process of forming a dye transfer image comprising imagewise-heating, by means of a thermal print head, a dye-donor element comprising a support having thereon a dye layer comprising a sublimable, metallizable dye precursor dispersed in a polymeric binder, and transferring a dye image to a dye-receiving element comprising a support having thereon a dye image-receiving layer containing a metal ion to form the dye transfer image, wherein the support of the dye-receiving layer is heated above ambient temperature from the side opposite to the side facing the thermal print head either prior to or during transfer of the thermal dye image.

Any sublimable, metallizable dye precursor can be employed in the dye-donor element used in the process of the invention provided it will react with a metal ion in the dye-receiving layer to form a metallized dye. For example, there may be employed chelate dyes such as

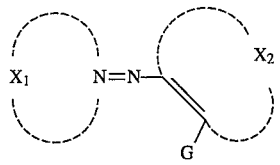

wherein $X_1$ represents a group of atoms necessary to complete an aromatic carbon ring or heterocyclic ring in which at least one ring comprises 5 to 7 atoms, and at least one position adjacent to the carbon bonded to the azo group is carbon, nitrogen, oxygen or sulfur;

$X_2$ represents a group of atoms necessary to complete an aromatic carbon ring or heterocyclic ring in which at least one ring comprises 5 to 7 atoms; and G represents a chelating group such as —OH, —NH-$COCH_3$, —COOH, etc.

Other chelate dyes useful in the process of the invention have the following formula:

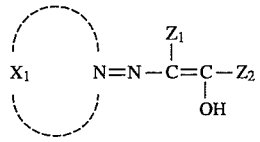

wherein $X_1$ is the same as above;

$Z_1$ represents an electron attractive group; and $Z_2$ represents an alkyl group or an aryl group.

Specific examples of dyes represented by the above formulas are disclosed in JP 78893/84, JP 109394/84, JP 2398/85 and U.S. Pat. No. 5,280,005. Other chelate dyes useful in the process of the invention are disclosed in U.S. Pat. No. 5,240,897.

The metal ion employed in the dye-receiving layer of the invention is usually present in a compound in the dye-receiver which can be thought of as a metal ion source. In a preferred embodiment, the metal ion is a polyvalent metal ion. Examples of such polyvalent metal ions include $Al^{3+}$, $Co^{2+}$, $Cr^{2+}$, $Cu^{2+}$, $Fe^{2+}$, $Mg^{2+}$, $Mn^{2+}$, $Ni^{2+}$, $Sn^{2+}$, $Ti^{2+}$ and $Zn^{2+}$. In a preferred embodiment, $Zn^{2+}$ is employed.

Metal ion-containing compounds which provide these polyvalent metals include inorganic or organic salts of the polyvalent metals and complexes of the polyvalent metals, and metals complexed to anionic moieties of polymers. Of these, a carboxylic acid group on a polymer backbone is preferred, such as Surlyn 1652® (the zinc salt of a poly-(methacrylic acid-co-ethylene) copolymer from DuPont Co.). Further examples of these compounds are disclosed in U.S. Pat. Nos. 4,987,049 and 5,280,005, JP 11535/61, JP 48210/80 and JP 129346/80, the disclosures of which are hereby incorporated by reference.

These metal ions are employed in the dye-receiving layer in the amount of about 0.2 to about 1.0 $g/m^2$ of the dye-receiving layer.

The back side heating of the dye-receiving element can be accomplished in many ways. For example, one can use a heated platen roller, radiant heat, resistive coatings on the receiver backside, etc. If a heated platen roller is used, it is usually heated from about 30° C. to about 75° C. over ambient temperature, i.e., from 55° C. to about 100° C. if ambient temperature is 25° C.

The support for the dye-receiving element employed in the process of the invention may be transparent or reflective, and may comprise a polymeric, synthetic paper, or cellulosic paper support, or laminates thereof. Examples of transparent supports include films of poly(ether sulfone)s, polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. No. 5,011,814 and 5,096,875, the disclosures of which are incorporated by reference.

The dye image-receiving layer may be present in any amount which is effective for its intended purpose. In general, good results have been obtained at a receiver layer concentration of from about 0.5 to about 15 g/m$^2$.

Resistance to sticking during thermal printing may be enhanced by the addition of release agents to the dye receiving layer or to an overcoat layer, such as silicone-based compounds, as is conventional in the art.

Dye-donor elements that are used with the dye-receiving element in the process of the invention conventionally comprise a support having thereon a dye-containing layer. Any dye can be used in the dye-donor element employed in the process of the invention provided it is transferable to the dye-receiving layer by the action of heat. Especially good results have been obtained with sublimable dyes. Dye donor elements applicable for use in the present invention are described, e.g., in U.S. Pat. Nos. 4,916,112, 4,927,803 and 5,023,228, the disclosures of which are incorporated by reference.

In a preferred embodiment of the invention, a dye-donor element is employed which comprises a poly(ethylene terephthalate) support coated with sequential repeating areas of cyan, magenta and yellow dye, and the dye transfer steps described above are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3.

The following example is provided to further illustrate the invention.

EXAMPLE

A dye-donor element was prepared by coating on a 6 μm poly(ethylene terephthalate support), (Mylar® from DuPont Co.), a dye layer comprising the metallizable magenta dye precursor identified below (0.269 g/m$^2$), CAP 482-0.5 (0.5 s cellulose acetate propionate) (Eastman Chemical Co.) (0.101 g/m$^2$), CAP 482-20 (20 s cellulose acetate propionate) (Eastman Chemical Co.)(0,303 g/m$^2$), FC-431® perfluoroamido surfactant (3M Co.) (0.054 g/m$^2$), S361-N11® surfactant (Shamrock Technologies Co.) (0.022 g/m$^2$) (a micronized blend of polyethylene, polypropylene, and oxidized polyethylene particles), toluene (58.4 wt. %), methanol (25 wt. %) and cyclopentane (4.4 wt. %).

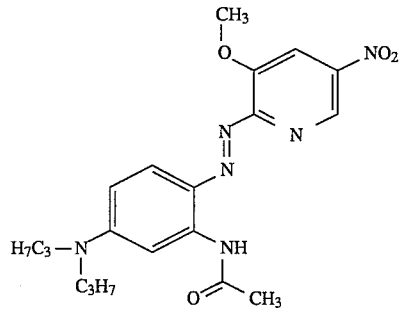

Metallizable Magenta Dye Precursor

A slipping layer was coated on the reverse side of the Mylar® support (the side opposite from the dye side) to reduce friction between donor and print head, as described in Example 1 of U.S. Pat. No. 5,350,732.

A dye-receiving element was prepared by extrusion-coating Surlyn 1652® (the zinc salt of a poly(methacrylic acid-co-ethylene) copolymer from DuPont Co.) at 34° C. and at a solids laydown of 12.2 g/m$^2$ onto a microvoided support. This support consisted of a cellulose paper core with a polyethylene layer (30.2 g/m$^2$) on the back side of a microvoided packaging film (Mobil OPP 350TW® available from Mobil Corp.) which had been extrusion-laminated with 12.2 g/m$^2$ polypropylene to the front side of the paper core. The microvoided support structure is described in detail in U.S. Pat. No. 5,244,861.

The imaged prints were prepared by placing the dye-donor element in contact with the polymeric dye-receiving layer side of the receiver element. The assemblage was fastened to the top of the motor driven 53 mm diameter rubber roller. A TDK thermal head, L-231, thermostated at 30° C. was pressed with a force of 36 N against the dye-donor element side of the assemblage pushing it against the rubber roller. The TDK L-231 thermal print head has 512 independently addressable heaters with a resolution of 5.4 dots/mm, an active printing width of 95 mm and an average heater resistance of 512 ohms. The imaging electronics were activated and the assemblage was drawn between the print head and roller at 20.6 mm/s. Coincidentally, the resistive elements in the thermal print head were pulsed on for 128 μs. Printing maximum density requires 127 pulses "on" time per printed line of 17 ms. When the voltage supplied was 10.7 volts, a maximum total energy required to print a 2.3 Dmax density was 3.7 mJ/dot. Details of an apparatus to generate this image are contained in U.S. Pat. No. 4,621,271.

The apparatus used in this experiment differed from a conventional thermal printing apparatus in that the platen roller was capable of being heated to an elevated temperature. Heat was transferred to the dye receiver, primarily by conduction. The unprinted dye-receiver material was threaded from a supply spool under the first of two guide rollers used to ensure proper contact with the heated platen. An external motor-driven take-up spool was used to transport the dye-receiver around the hot platen to the thermal print head where it was contacted with the dye-donor material. Upon exit from the area under the thermal print head, the dye-donor was stripped off and the printed dye-receiver was transported around the heated platen to the second guide roller. After passing under the second guide roller, the printed dye-receiver was removed from contact with the heated platen and directed to the take-up spool.

In this example, a magenta dye was transferred from the dye-donor to react with the zinc metal ion in the dye-receiver to form a dye of cyan hue. The extent or completion of the resulting metal complex formation was monitored by measuring the red and-green Status A reflection densities of the printed receiver with an X-Rite Densitometer (X-Rite Co., Grandville, Mich.).

The donor and receiver samples as prepared above were used in a series of experiments with the platen roller not heated (ambient temperature of ~25° C.) as well as with the platen roller heated to 55°, 70°, and 100° C., respectively. The thermally transferred image in each case consisted of a uniform density patch with an area of approximately 10 $cm^2$ as well as a step wedge gradient. Using the densitometer, the Status A red and green reflection densities of the step wedge gradients were measured as follows:

TABLE

| Platen Temp. (°C.) | Red Density | Green Density | Red/Green |
|---|---|---|---|
| ambient ~25 | 0.68 | 0.48 | 1.4 |
| 55 | 0.75 | 0.46 | 1.6 |
| 70 | 0.75 | 0.43 | 1.7 |
| 100 | 0.85 | 0.50 | 1.7 |

The above data clearly show that the red/green density ratio increases with the temperature of the heated platen roller. Hence, the extent of the reaction between the metallizable dye and the metal ion is increased by heating the dye-receiver element during the thermal transfer process. In the present case, a cyan hue of enhanced density was obtained.

The invention has been described in detail with particular reference to preferred embodiments thereof, but it will be understood that variations and modifications can be effected within the spirit and scope of the invention.

What is claimed is:

1. A process of forming a dye transfer image comprising imagewise-heating, by means of a thermal print head, a dye-donor element comprising a support having thereon a dye layer comprising a sublimable, metallizable dye precursor dispersed in a polymeric binder, and transferring a dye image to a dye-receiving element comprising a support having thereon a dye image-receiving layer containing a metal ion to form said dye transfer image, wherein said support of said dye-receiving layer is heated above ambient temperature from the side opposite to the side facing said thermal print head either prior to or during transfer of said thermal dye image.

2. The process of claim 1 wherein said support of said dye-receiving layer is heated by means of a heated platen roller.

3. The process of claim 1 wherein said support of said dye-receiving layer is heated above ambient temperature from the side opposite to said thermal print head during transfer of said thermal dye image.

4. The process of claim 1 wherein said sublimable, metallizable dye precursor has the formula:

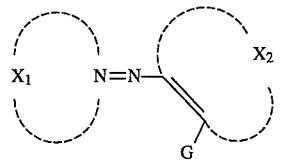

wherein $X_1$ represents a group of atoms necessary to complete an aromatic carbon ring or heterocyclic ring in which at least one ring comprises 5 to 7 atoms, and at least one position adjacent to the carbon bonded to the azo group is carbon, nitrogen, oxygen or sulfur;

$X_2$ represents a group of atoms necessary to complete an aromatic carbon ring or heterocyclic ring in which at least one ring comprises 5 to 7 atoms; and G represents a chelating group.

5. The process of claim 1 wherein said metal ion in said dye-receiving layer is zinc.

* * * * *